US007152957B2

(12) United States Patent
Mori

(10) Patent No.: US 7,152,957 B2
(45) Date of Patent: Dec. 26, 2006

(54) RECORDING DEVICE BOARD HAVING A PLURALITY OF BUMPS FOR CONNECTING AN ELECTRODE PAD AND AN ELECTRODE LEAD, LIQUID EJECTION HEAD, AND MANUFACTURING METHOD FOR THE SAME

(75) Inventor: Toshihiro Mori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 398 days.

(21) Appl. No.: 10/731,118

(22) Filed: Dec. 10, 2003

(65) Prior Publication Data

US 2004/0119787 A1 Jun. 24, 2004

(30) Foreign Application Priority Data

Dec. 18, 2002 (JP) ..... 2002-366631

(51) Int. Cl.
*B41J 2/14* (2006.01)
*B41J 2/16* (2006.01)

(52) U.S. Cl. ..... 347/50; 347/58

(58) Field of Classification Search ..... 347/20, 347/50, 56–59, 63, 67; 438/614–617
See application file for complete search history.

(56) References Cited

U.S. PATENT DOCUMENTS 5,182,577 A 1/1993 Ishinaga et al. ..... 347/58
5,660,739 A 8/1997 Ozaki et al. ..... 347/62
5,896,147 A 4/1999 Mori et al. ..... 347/61
6,315,396 B1 11/2001 Ozaki et al. ..... 347/60
6,609,782 B1 * 8/2003 Mori ..... 347/50
6,799,833 B1 * 10/2004 Watanabe ..... 347/50

FOREIGN PATENT DOCUMENTS

JP 62-283644 * 5/1986 ..... 438/614

* cited by examiner

*Primary Examiner*—Juanita D. Stephens
(74) *Attorney, Agent, or Firm*—Fitzpatrick, Cella, Harper & Scinto

(57) ABSTRACT

The invention is intended to suppress failures of connected portions between electrode pads and bumps. A liquid ejection head comprises a recording device board including an energy generating device disposed thereon to generate energy for ejecting a liquid through an ejection orifice, and an electrode pad which is disposed in a recess formed in the recording device board and is electrically communicated with the energy generating device. The liquid ejection head further comprises an electrode lead for supplying power to the electrode pad externally of the recording device board, a bump for connecting the electrode pad and the electrode lead to establish electrical communication therebetween, and a sealing resin material filled in the recess to surround an electrically connected portion between the electrode pad and the bump without covering the bump.

13 Claims, 15 Drawing Sheets

(A-A)

(B-B)

RECORDING DEVICE BOARD HAVING A PLURALITY OF BUMPS FOR CONNECTING AN ELECTRODE PAD AND AN ELECTRODE LEAD, LIQUID EJECTION HEAD, AND MANUFACTURING METHOD FOR THE SAME

BACKGROUND OF THE INVENTION

1. Field of the Invention

The present invention relates to a liquid ejection head for ejecting a liquid in the form of droplets through ejection orifices, a recording device board for use in the liquid ejection head, and a manufacturing method for the same.

2. Description of the Related Art

A typical recording device board for use in a liquid ejection head for ejecting a liquid is constructed as shown in FIGS. 15A to 15C. Also, as shown in FIG. 16, the recording device board is electrically connected to a flexible film wiring board.

More specifically, as shown in FIGS. 15A to 15C, a recording device board J1100 for use in the liquid ejection head has an ink supply port J1102 formed to penetrate through it for supplying ink from the rear side. On the surface of a Si substrate J1110, a plurality of electro-thermal transducers (not shown) for applying ejection energy to the ink are arranged on each of both sides of the ink supply port J1102. An ejection substrate J1109 is disposed on the Si substrate J1110, and a plurality of ejection orifices J1107 are formed through the ejection substrate J1109 in one-to-one opposite relation to the plurality of electro-thermal transducers. Further, in both end portions of the surface of the Si substrate J1110, a plurality of electrode pads J1104 are provided and electrically connected to the corresponding electro-thermal transducers.

As shown in FIG. 16, a recording device unit J1002 is constructed such that the plurality of electrode pads J1104 provided on the Si substrate J1110, stud bumps J1105 electrically joined to respective surfaces of the corresponding electrode pads J1104, and a plurality of electrode leads J1013 provided on a flexible film wiring board J1300 are electrically interconnected by, e.g., single point bonding.

A first sealing-resin material J1307 is filled around the Si substrate J1110. Electrically connected portions on the Si substrate J1110 are entirely covered with a second sealing resin material J1308 to protect those connected portions against corrosion caused by ink and disconnection caused by external forces. The first and second sealing resin materials J1307, J1308 are each made of an ordinary thermosetting resin and ensure firm rigidity after setting.

However, the known method of manufacturing the ink jet recording head, described above, has the following problems to be overcome.

In the known method of manufacturing the ink jet recording head, the stud bumps joined to the surfaces of the electrode pads on the recording device board and the electrode leads provided on the flexible film wiring board are electrically connected to each other in a heated state at about 200° C. by using a heat tool, which is heated up to about 500° C., with gang bonding for electrically connecting all the connection points at a time or single point bonding for electrically connecting the connection points one by one.

In the known method of manufacturing the ink jet recording head, therefore, a temperature drop of the flexible film wiring board down to the normal temperature after the bonding causes thermal shrinkages of the electrode leads and a base film, whereupon mechanical loads are imposed on the recording device board and joined portions on it, i.e., the electrically connected portions between the stud bumps and the electrode pads. As a result, the stud bumps may be peeled off from the electrode pads on the recording device board, and the recording device board may be damaged.

As a result of conducting studies with the above-mentioned problems in mind, the inventor has found that the joined portions can be reinforced by filling a sealing resin material so as to cover the peripheries of connection surfaces between the stud bumps and the electrode pads. This method, however, has a problem that it is very difficult to adjust the filling amount of the sealing resin material. If the filling amount is too small, the joined portions cannot be fully covered in a satisfactory condition. Conversely, if the filling amount is too large, the stud bumps are completely covered and the electrical connection cannot be ensured.

SUMMARY OF THE INVENTION

It is an object of the present invention to provide a liquid ejection head in which the amount of a sealing resin material filled to seal surroundings of an electrically connected portion between an electrode pad on a recording device board and a bump joined onto the electrode pad can be adjusted so as to provide satisfactory sealing without completely covering the bump, whereby that electrically connected portion and the recording device board are protected against failures otherwise caused by thermal shrinkage of a flexible film wiring board. Other objects of the present invention are to provide a recording device board for use in the liquid ejection head and a manufacturing method for the same.

To achieve the above object, the present invention provides a liquid ejection head comprising a recording device board including an energy generating device disposed thereon to generate energy for ejecting a liquid through an ejection orifice, an electrode pad which is disposed in a recess formed in the recording device board and is electrically communicated with the energy generating device, an electrode lead for supplying power to the electrode pad externally of the recording device board, a bump for connecting the electrode pad and the electrode lead to establish electrical communication therebetween, and a sealing resin material filled in the recess to surround an electrically connected portion between the electrode pad and the bump without covering the bump.

Further objects, features and advantages of the present invention will become apparent from the following description of the preferred embodiments with reference to the attached drawings.

DESCRIPTION OF THE PREFERRED EMBODIMENTS

Embodiments of the present invention will be described below with reference to the drawings.

A detailed structure of an ink jet recording head according to a first embodiment will be described later, and a description is first made of the structure of a principal part of a recording device unit.

Figure 12:
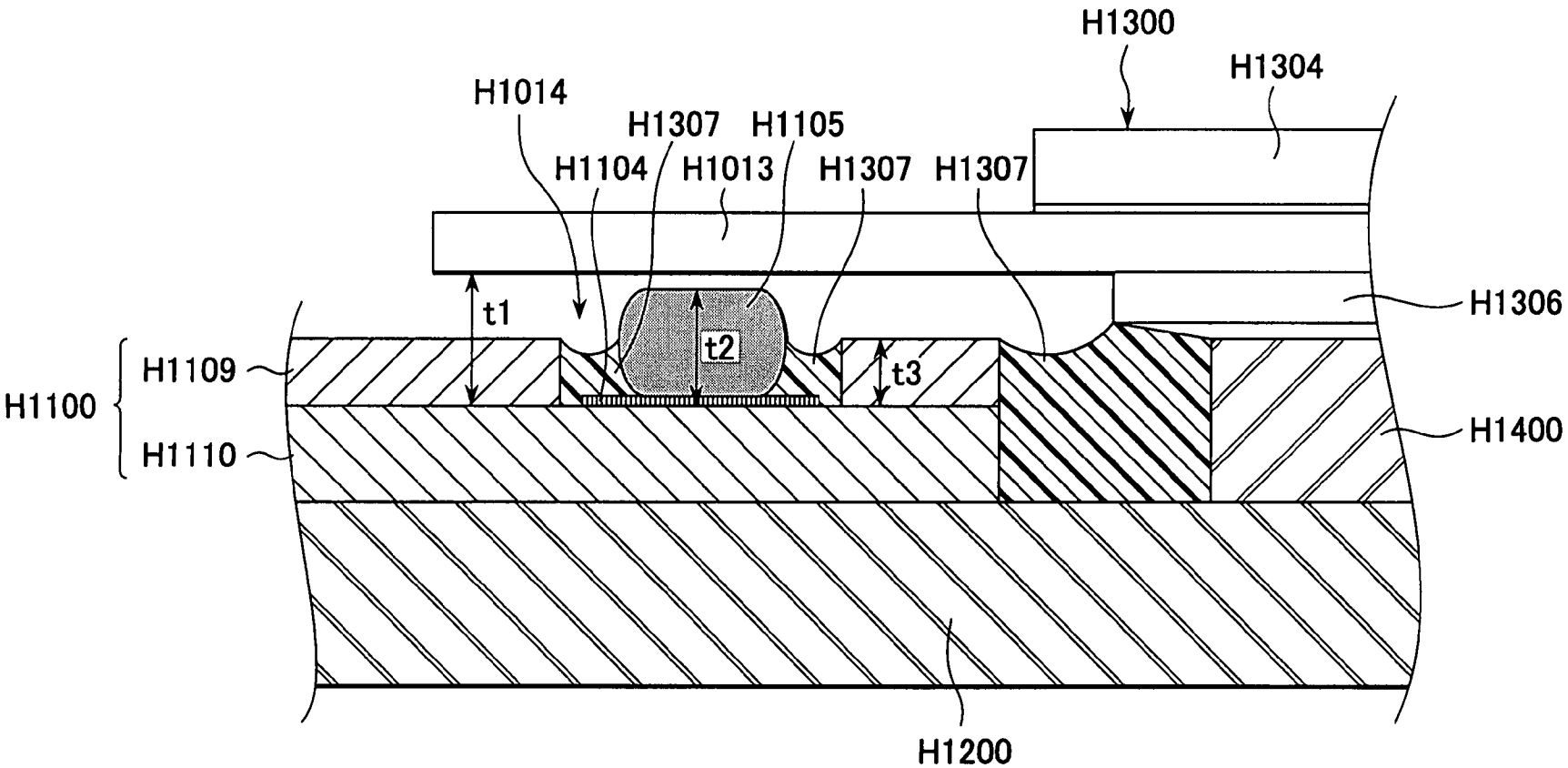
FIG. 12 is a sectional view showing a principal part of a recording device unit according to the first embodiment.

FIG. 12 is a sectional view showing a first recording device board mounted in a recording device unit according to the first embodiment. Note that while the structure of the principal part of the recording device unit will be described below in connection with, by way of example, the first recording device board, a second recording device board (described later) is also similarly constructed and therefore a description of the second recording device board is omitted.

As shown in FIG. 12, an electrode pad H1104 is provided on a principal face of a first recording device board H1100, and a stud bump H1105 substantially in the form of a barrel is joined onto the electrode pad H1104.

An ejection substrate H1109 serving as a nozzle member has a first sealing resin material reservoir H1014 substantially in a rectangular shape, which is formed to surround the stud bump H1105 when the ejection substrate H1109 is disposed on a Si substrate H1110.

The first sealing resin material reservoir H1014 has a height $t_3$ (equal to a thickness of the ejection substrate H1109) from a principal face of the Si substrate H1110 smaller than a height $t_2$ of the stud bump H1105 from a principal face (electrical connection surface) of the electrode pad H1104. A flexible film wiring board H1300 is disposed such that a height $t_1$ from the principal face of the Si substrate H1110 to a lower surface of an electrode lead H1013 is larger than the height $t_2$ of the stud bump H1105. Thus, the relationship of $t_1>t_2>t_3$ is satisfied. In other words, an upper portion of the stud bump H1105, serving as an electrical connecting portion to the electrode lead H1013 and introducing therethrough electric power supplied as energy for ejection of the ink from the outside of the recording device board H1100 to the electrode pad H1104, is projected out of the first sealing resin material reservoir H1014. Accordingly, a certain gap is left between an upper surface of the ejection substrate H1109 and the lower surface of the electrode lead H1013.

With the arrangement described above, when a first sealing resin material H1307 is filled in the first sealing resin material reservoir H1014, the first sealing resin material H1307 is restricted from reaching the electrode lead H1013. Therefore, a risk of an electrical connection failure is avoided which may occur if, before the stud bump H1105 and the electrode lead H1013 are electrically connected to each other, the first sealing resin material H1307 spreads along the lower surface of the electrode lead H1013 and interposes between connection surfaces of both the members.

Figure 13:
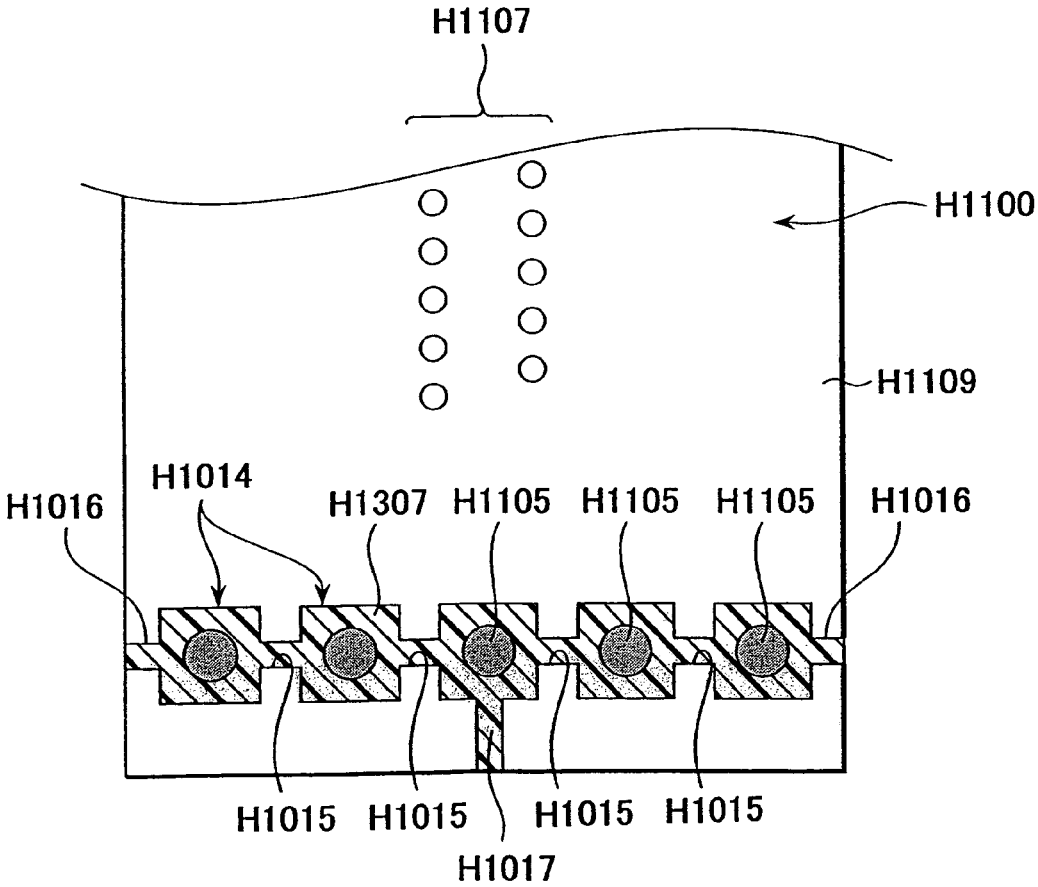
FIG. 13 is a plan view of the recording device unit.

Further, as shown in FIG. 13, the first sealing resin material reservoirs H1014 surrounding the corresponding stud bumps H1105 are communicated with each other through communication grooves H1015. Also, two communication grooves H1016 are formed such that the first sealing resin material reservoirs H1014 positioned nearest to opposite outer peripheries of the ejection substrate H1109 are communicated with respective outer peripheral side surfaces of the first recording device board H1100 through the communication grooves H1016. This arrangement enables the first sealing resin material H1307 to be successively filled into all of the first sealing resin material reservoirs H1014.

Still another communication groove H1017 is formed to communicate the first sealing resin material reservoir H1014, which is positioned at one end of the first recording device board H1100 near the center thereof, with an outer peripheral end surface of the first recording device board H1100. The communication groove H1017 serves to more positively suppress the first sealing resin material H1307 from spilling out of the first sealing resin material reservoirs H1014, and to increase the filling speed for an improvement of the filling efficiency.

The first sealing resin material reservoirs H1014 can be formed in an extended portion of the ejection substrate H1109 in which ejection orifices H1107 are formed. Alternatively, for example, in the case of requiring the height of the first sealing resin material reservoirs H1014 to be more finely adjusted, another member for constituting a part of each first sealing resin material reservoir H1014 may be additionally disposed on the ejection substrate H1109.

Other modified structures of the stud bump will be described below with reference to the drawings.

Figure 14A:
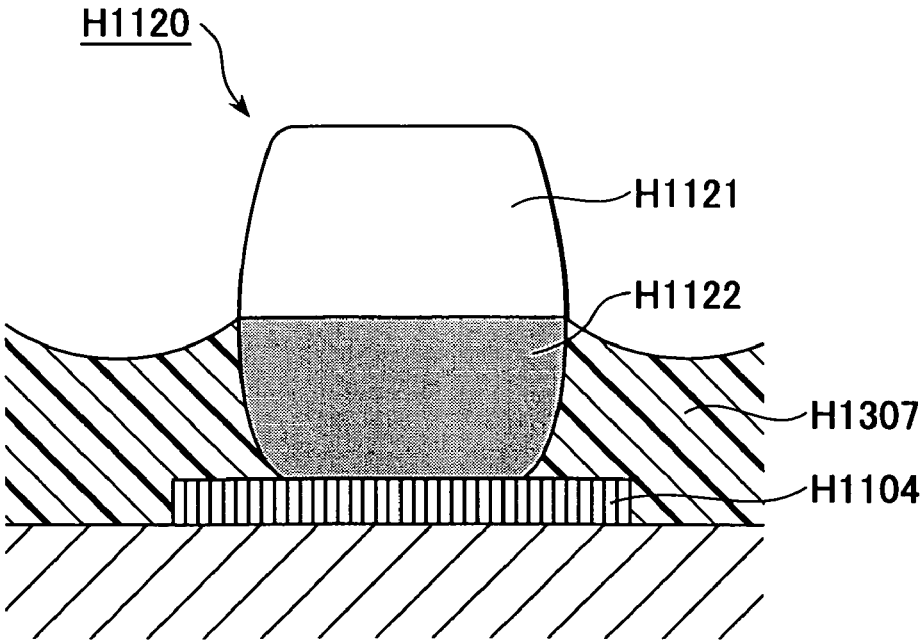
FIG. 14A is a schematic view for explaining the structure of a stud bump according to a second embodiment of the present invention.

As shown in FIG. 14A, a stud bump H1120 according to a second embodiment has a repellent area H1121 having a low affinity with the sealing resin and formed in an upper portion of the stud bump H1120 nearer to its electrical connection surface to the electrode lead H1013, and an affinitive area H1122 having a high affinity with the sealing resin and formed in a lower portion of the stud bump H1120 nearer to its electrical connection surface to the electrode pad H1104. The repellent area H1121 and the affinitive area H1122 are formed by covering outer peripheral surfaces of the upper and lower portions of the stud bump H1120 respectively with a film having a low affinity with the sealing resin and a film having a high affinity with it.

With the stud bump H1120 according to the second embodiment, therefore, even when the first sealing resin material H1307 is excessively filled in the first sealing resin material reservoir H1014, the low affinity of the repellent area H1121 with the sealing resin acts to suppress the first sealing resin material H1307 from rising up to the upper portion of the stud bump.

A stud bump according to a third embodiment will be described with reference to the drawing.

Figure 14B:
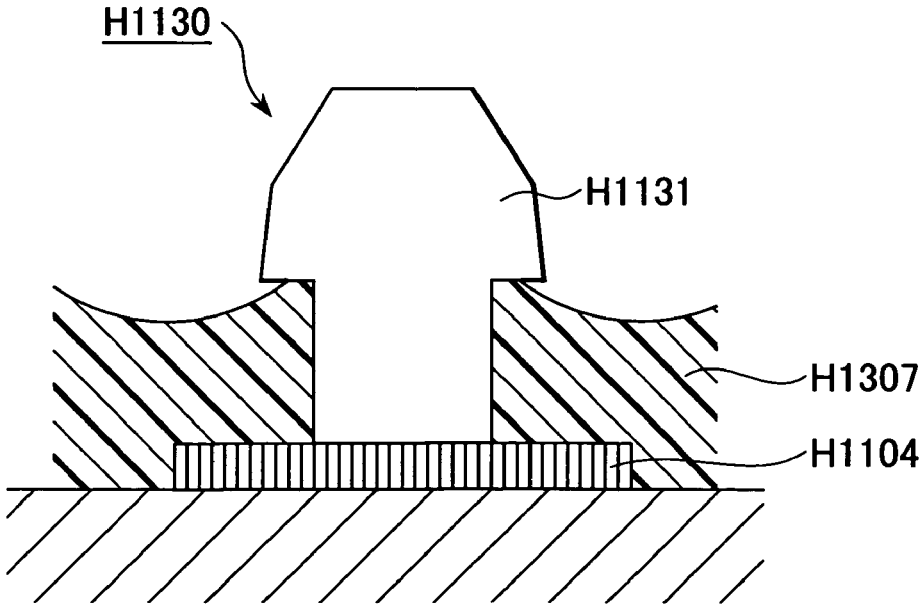
FIG. 14B is a schematic view for explaining the structure of a stud bump according to a third embodiment of the present invention.
Figure 15A:
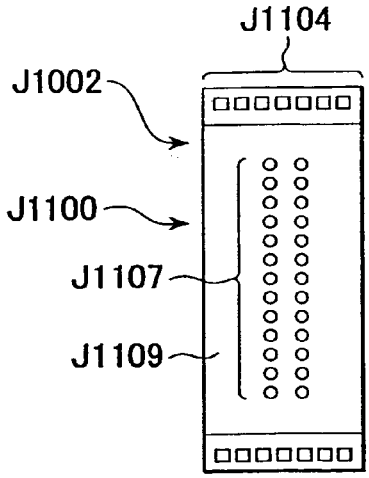
FIG. 15A PRIOR ART
FIG. 15A is a plan view of a known typical recording device board, looking the recording device board from the ejection orifice side.
Figure 15C:
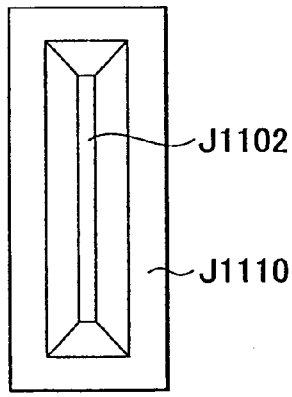
FIG. 15C PRIOR ART
FIG. 15C is a schematic plan view of the recording device board shown in FIG. 15A, looking the recording device board from the ink supply port side.
Figure 15B:
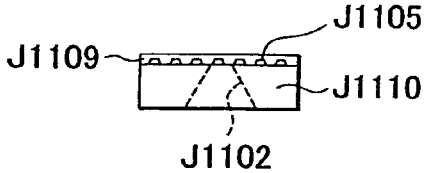
FIG. 15B PRIOR ART
FIG. 15B is a schematic side view of the recording device board shown in FIG. 15A.
Figure 16:
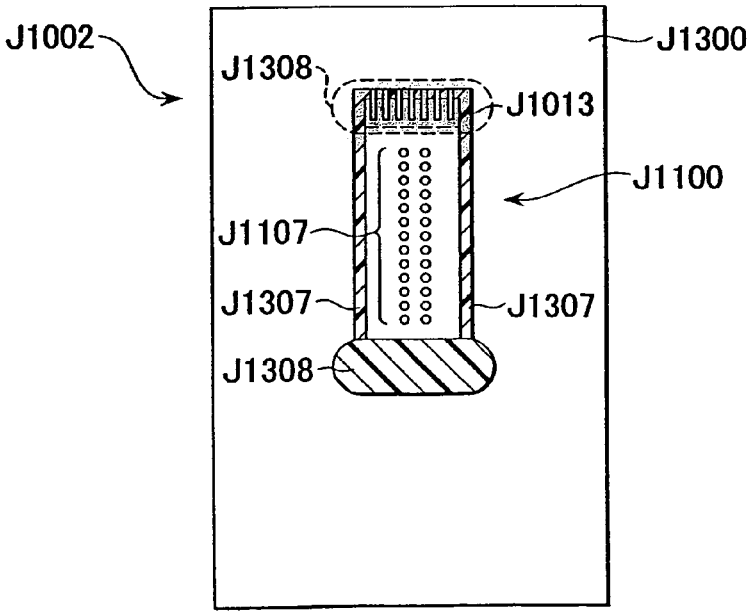
FIG. 16 PRIOR ART
FIG. 16 is a plan view showing a state in which of the recording device board shown in FIGS. 15A to 15C is electrically connected to a flexible film wiring board.

As shown in FIG. 14B, a stud bump H1130 according to the third embodiment has a arrowhead-like shape in which an upper portion of the stud bump nearer to its electrical connection surface to the electrode lead H1013 has a larger-diameter portion H1131 with a larger diameter than a lower portion of the stud bump nearer to its electrical connection surface to the electrode pad H1104. Stated another way, the stud bump H1130 is formed such that a cross-sectional area parallel to the principal face of the electrode pad H1104 is larger in the upper portion nearer to the electrical connection surface to the electrode lead H1013 than in the lower portion nearer to the electrical connection surface to the electrode pad H1104.

Further, a projected lower end of the larger-diameter portion H1131 is located halfway the height $t_2$ of the stud bump H1130 vertical to the principal face of the electrode pad H1104 and, more specifically, it is positioned substantially at the same level as the height of the first sealing resin material reservoir H1014.

With the stud bump H1130 according to the third embodiment, therefore, even when the first sealing resin material H1307 is excessively filled in the first sealing resin material reservoir H1014, the projected lower end of the larger-diameter portion H1131 acts to prevent the first sealing resin material H1307 from reaching to the electrical connecting portion of the stud bump H1130.

More preferably, the third embodiment is combined with the second embodiment; namely the larger-diameter portion H1131 of the stud bump H1130 according to the third embodiment is provided in addition to the formation of the repellent area H1121 and the affinitive area H1122 in the stud bump H1120 according to the second embodiment.

A detailed structure of the ink jet recording head according to the first embodiment will be described below. Note that, in the recording device unit employed in the ink jet recording head described below, the stud bump H1105, the first sealing resin material reservoirs H1014, and the communication grooves H1015, H1016 and H1017 are formed.

Figure 1:
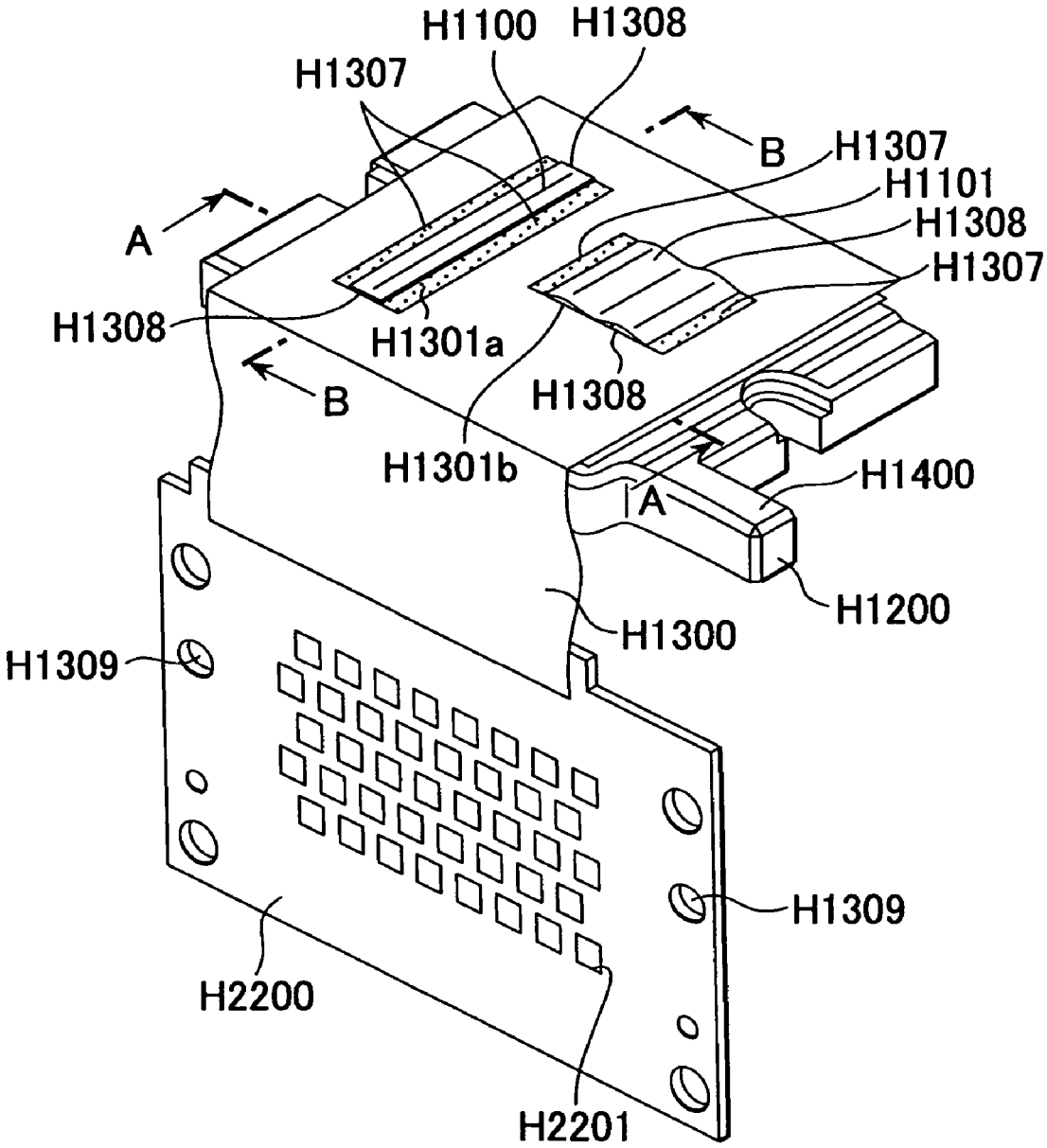
FIG. 1 is a perspective view of an ink jet recording head according to a first embodiment of the present invention.
Figure 2:
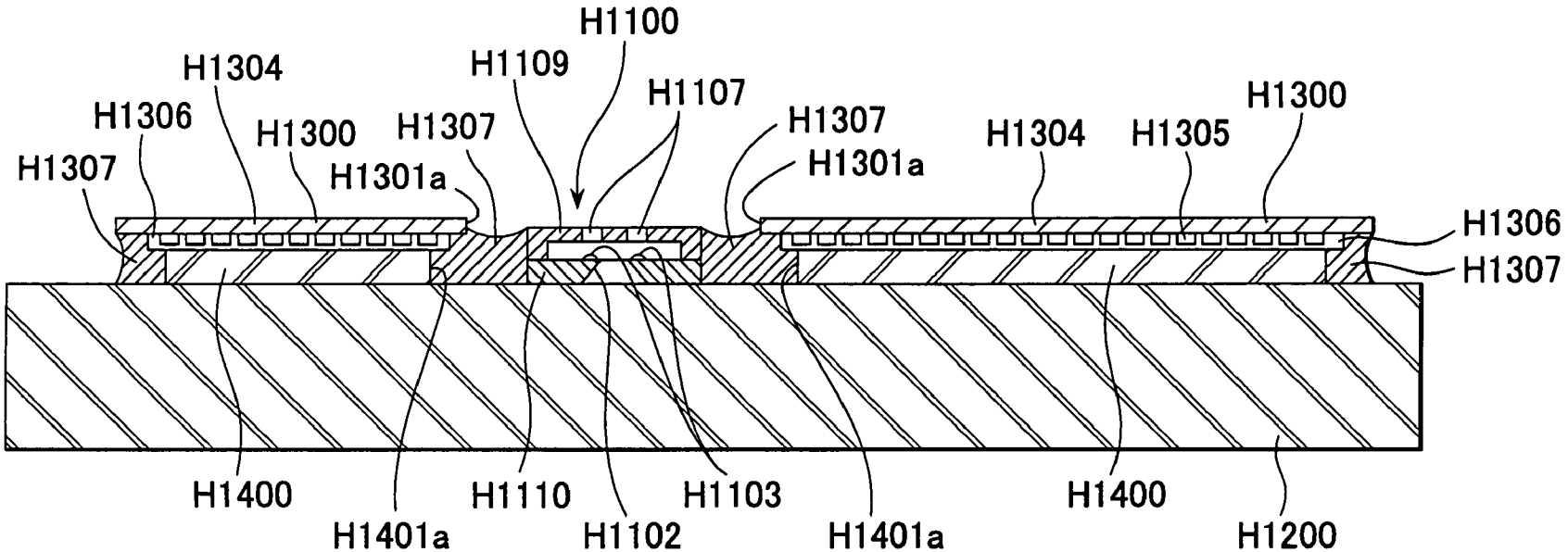
FIG. 2 is a sectional view of the ink jet recording head taken along the line A—A in FIG. 1.
Figure 3:
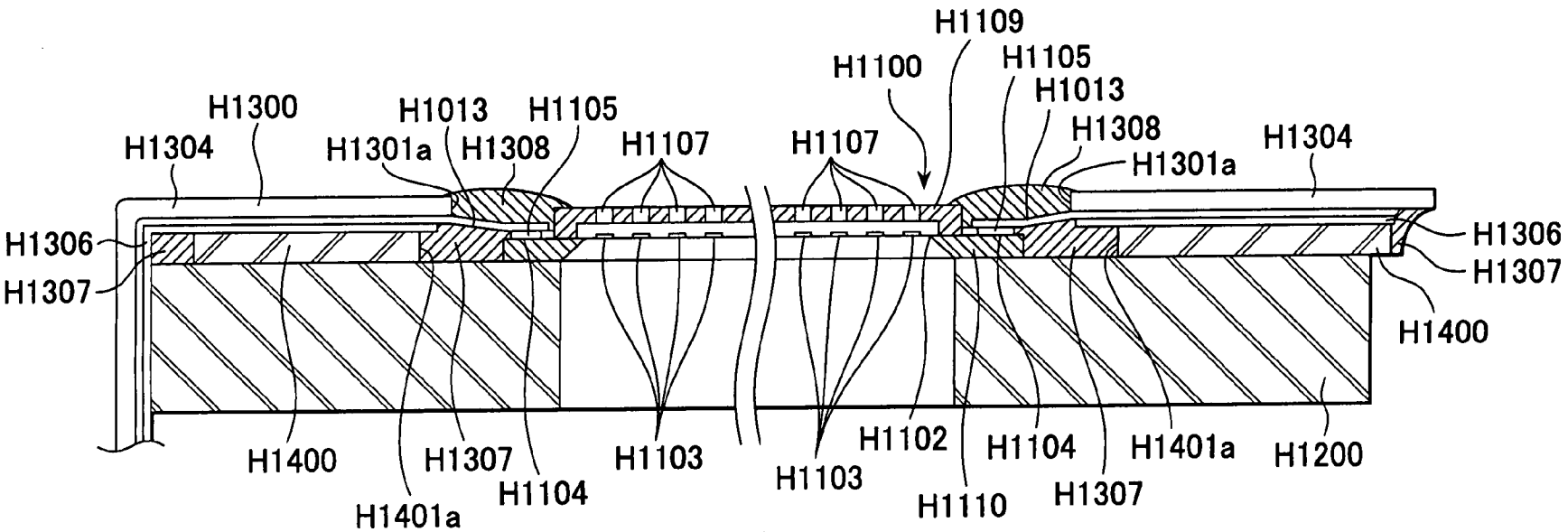
FIG. 3 is a sectional view of the ink jet recording head taken along the line B—B in FIG. 1.

FIG. 1 is a perspective view of the ink jet recording head according to the first embodiment of the present invention, FIG. 2 is a sectional view taken along the line A—A in FIG. 1, and FIG. 3 is a sectional view taken along the line B—B in FIG. 1.

As shown in FIGS. 1 to 3 and 6, the ink jet recording head H1001 (referred to simply as the "recording head H1001" hereinafter) according to the first embodiment comprises a plurality of first and second recording device boards H1100, H1101 (two in the first embodiment for the sake of explanation) having different outer shapes and sizes from each other; a first plate H1200 for supporting the recording device boards H1100, H1101; and a flexible film wiring board H1300 for applying electric pulses to the recording device boards H1100, H1101.

The ejection board H1109 is disposed on the surface side of each of the first and second recording device boards H1100, H1101, and a plurality of ejection orifices H1107 for ejecting ink are formed through the ejection board H1109 in two rows at positions opposite to the electro-thermal transducers H1103 serving as ejection energy generating devices. At the center of each of the first and second recording device boards H1100, H1101 on the rear side (the underside in these Figs.), the ink supply port H1102 is provided for supply of the ink ejected through the ejection orifices H1107 over substantially the same length as the array of the ejection orifices H1107 in a longitudinal direction thereof.

Also, at both ends of each of the first and second recording device boards H1100, H1101, a plurality of electrode pads H1104 are provided and electrically connected to the electro-thermal transducers H1103 in one-to-one relation. As generally practiced, the stud bumps H1105 made of gold wires are electrically joined respectively to the electrode pads H1104. Each of the first and second recording device boards H1100, H1101 is disposed such that its rear surface is adjacent to an upper surface of the first plate H1200 mounted to an ink supply member H1500 and is fixedly bonded at a predetermined position with a high accuracy nearly on the order of several μm to several tens of μm. Note that only several ejection orifices H1107 and electrode pads H1104 are shown in the drawings for illustrative purpose, but they are in fact provided in number ranging from several tens to several hundreds.

As shown in FIGS. 2 and 3, the flexible film wiring board H1300 has a base film H1304 on which a wiring H1305 and a resist layer H1306 are successively formed in this order.

Figure 6:
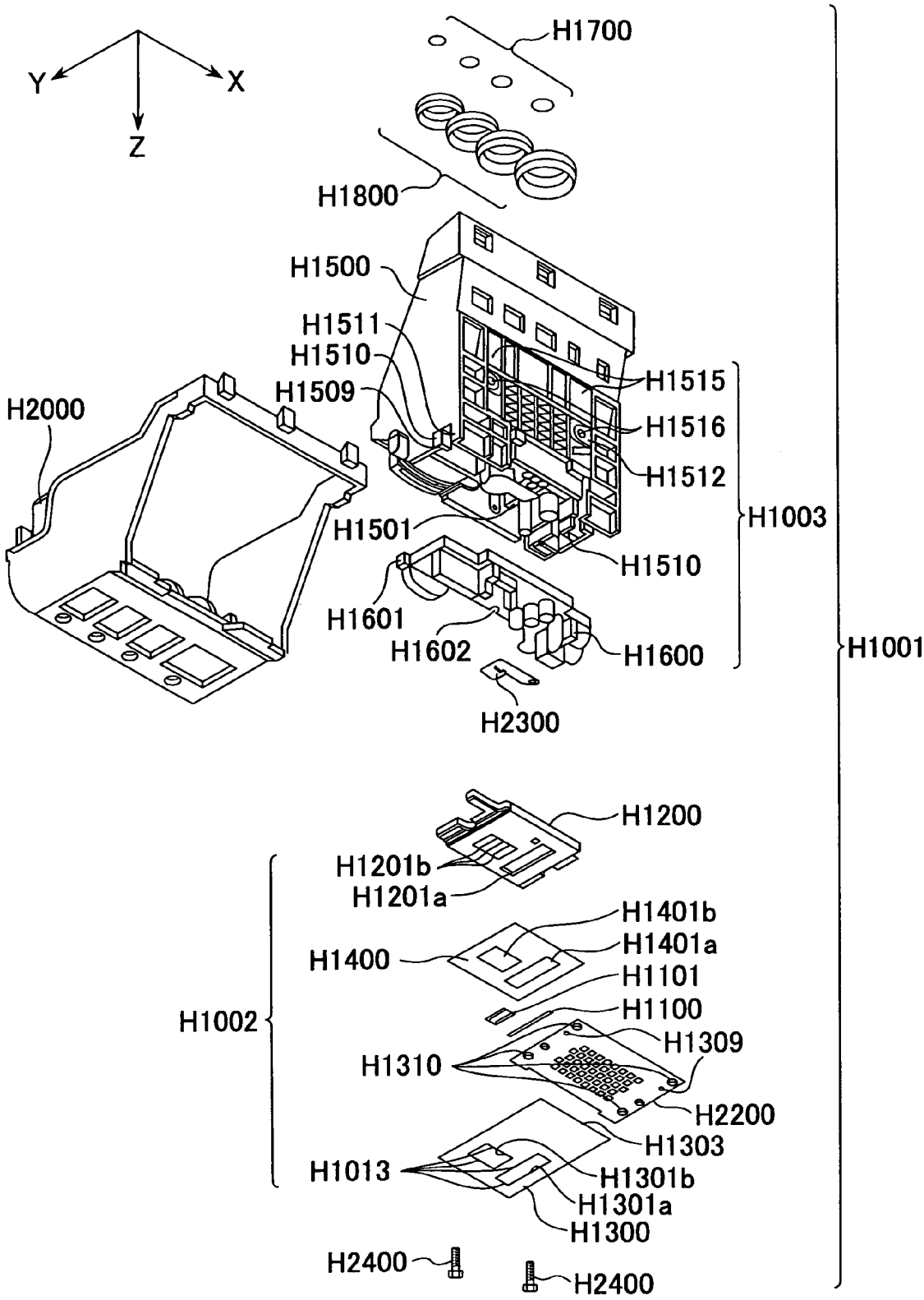
FIG. 6 is an exploded perspective view of the recording head cartridge with the recording head shown in an exploded view.

As also shown in FIG. 6, the flexible film wiring board H1300 has two openings H1301*a*, H1301*b* in which the first and second recording device boards H1100, H1101 are assembled in an exposed state, respectively. For electrical mounting of the two recording device boards H1100, H1101, the electrode leads H1013 to be electrically connected to the electrode pads H1104 of each of the recording device boards H1100, H1101 are disposed at edges of each of the openings H1301*a*, H1301*b* in the same number as the electrode pads H1104. As shown in FIG. 3, the electrode leads H1013 are electrically connected to the corresponding electrode pads H1104 of each recording device board H1100, H1101 through the stud bumps H1105.

That electrical connection is performed by applying a certain load and ultrasonic vibration for a predetermined time while the electrode connection area is heated to about 150° C.–200° C., so that gold-to-gold bonding occurs between contact surfaces of the gold bumps on the electrode pads H1104 and the electrode leads H1013 of the flexible film wiring board H1300 which are plated with gold.

While single point bonding for electrically connecting the connection points one by one is employed in this embodiment, any other connecting methods, such as gang bonding for connecting all of the connection points at a time by using a thermally fusing unit, are also usable. An optimum one may be selected from among the single point bonding, the gang bonding, and other connecting methods in consideration of the existing production line.

In the recording head H1001 thus constructed, prior to electrically connecting the electrode leads H1013 of the flexible film wiring board H1300 and the electrode pads H1104 of each recording device board H1100, H1101 through the stud bumps H1105, the first sealing resin material H1307 is applied and hardened in recesses defined by the openings H1301*a*, H1301*b* of the flexible film wiring board H1300, openings H1401*a*, H1401*b* of a second plate H1400 and the outer peripheries of the recording device boards H1100, H1101, around the recording device boards H1100, H1101, and over joined portions between the electrode pads H1104 and the stud bumps H1105 both provided on each of the recording device boards H1100, H1101, thereby protecting the recording device boards H1100, H1101 and those joined portions.

The first sealing resin material H1307 used here is a thermosetting resin material having elasticity even after curing, e.g., a thermosetting silicone-denatured epoxy resin material (made by Japan Rec Co., Ltd.; NR200C). In this embodiment, the first sealing resin material H1307 was preheated at 100° C. for 1 to 3 hours and then hardened by post-curing performed at 150° C. for 3 hours.

In the state in which the first sealing resin material H1307 has been applied to reinforce the respective surroundings of the recording device boards H1100, H1101 and the joined portions between the electrode pads H1104 and the stud bumps H1105 on the recording device boards H1100, H1101, the electrode leads H1013 of the flexible film wiring board H1300 and the electrode pads H1104 of the recording device boards H1100, H1101 are electrically connected to each other through the stud bumps H1105.

Subsequently, a space over the electrically connected portion between each recording device board H1100, H1101 and the flexible film wiring board H1300 (i.e., an area ranging from the flexible film wiring board H1300 to the ejection substrate H1109 with the electrode leads H1013 interposed between them) is covered and protected by a second sealing resin material H1308.

The second sealing resin material H1308 used here is a thermosetting resin material becoming hard and having relatively high mechanical strength after curing, e.g., a thermosetting epoxy resin material (made by Matsushita Electric Works Co., Ltd.; CV5420D). In this embodiment, the second sealing resin material H1308 was hardened with a reaction developed at 150° C. for 1 hour. The hardening conditions can be decided case by case in consideration of a failure possibly caused by heat generated by devices.

Thereafter, the flexible film wiring board H1300 is electrically connected to an electrical contact board H2200 provided with external input terminals H2201 for transmitting electrical signals, e.g., recording information, from the recording apparatus side to the recording head H1001. As a matter of course, the flexible film wiring board H1300 and the electrical contact board H2200 may be integrally constructed using a single board. Then, the flexible film wiring board H1300 is bent so as to extend along the ink supply member H1500 and affixed to it. The recording head H1001 is thereby completed.

FIGS. 4 to 11 are explanatory views for explaining a recording head cartridge, a recording head, and ink tanks to which the present invention is suitably applied, as well as positional relationships among those components.

The individual components will be described below with reference to the drawings.

Figure 4:
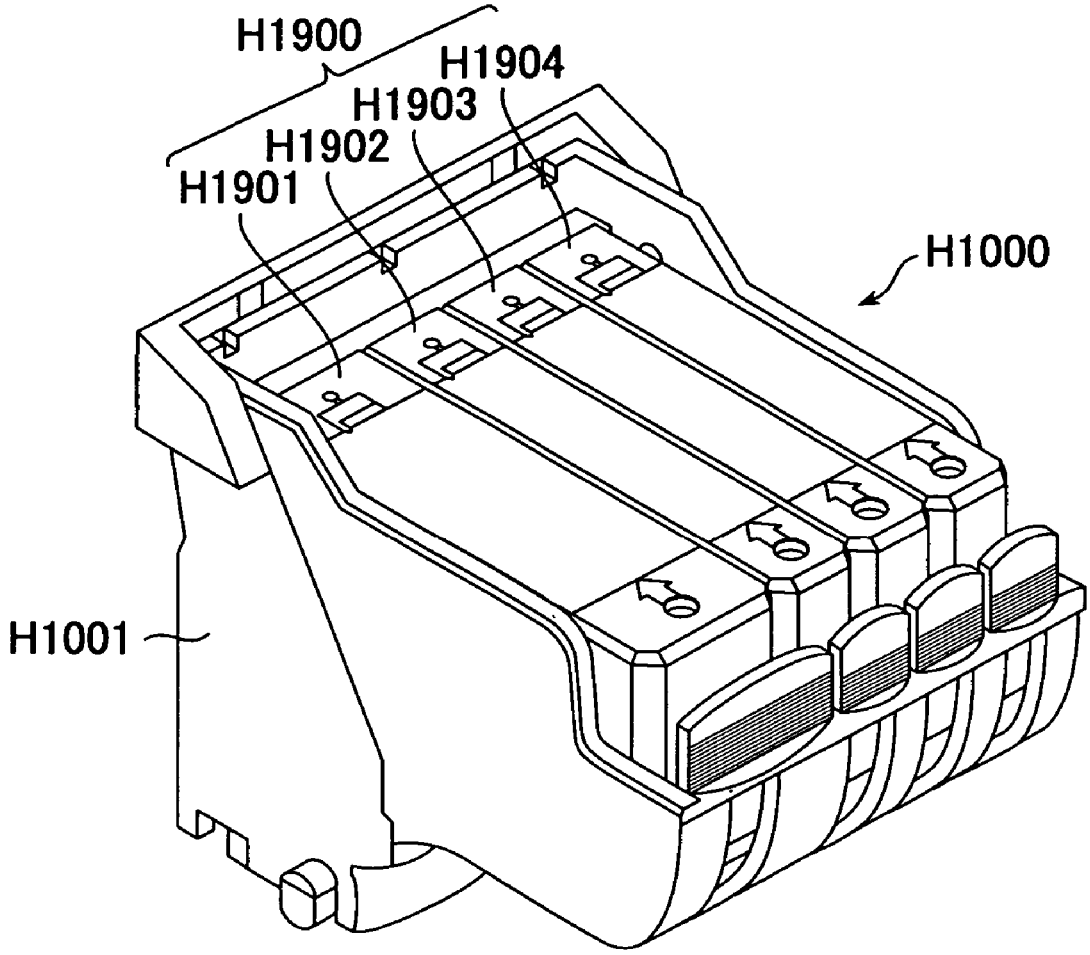
FIG. 4 is a perspective view showing a state in which ink tanks are mounted to a recording head cartridge in which the ink jet recording head is assembled.

As shown in FIG. 4, the recording head H1001 of this embodiment is one component of a recording head cartridge H1000. The recording head cartridge H1000 comprises the recording head H1001 and ink tanks H1900 (H1901, H1902, H1903 and H1904) detachably attached to the recording head H1001.

The recording head cartridge H1000 is detachably attached to a carriage (not shown) which is mounted in the recording apparatus. When the recording head cartridge H1000 is attached to the carriage, it is set to a predetermined position for electrical connection and held in that position by a positioning member provided on the carriage side.

The ink tank H1901 contains black ink; the ink tank H1902 contains cyan ink; the ink tank H1903 contains magenta ink; and the ink tank H1904 contains yellow ink. These ink tanks H1901, H1902, H1903 and H1904 are detachably attached to the recording head H1001, allowing each ink tank to be independently replaced with a new one. Hence, the running cost of image recording in the recording apparatus can be reduced.

The individual components of the recording head H1001 will be described in more detail below one by one.

(1) Recording Head

The recording head H1001 is an ink jet recording head wherein recording is carried out using electro-thermal transducers for generating thermal energy sufficient to cause film boiling of ink in accordance with an applied electrical signal.

Figure 5:
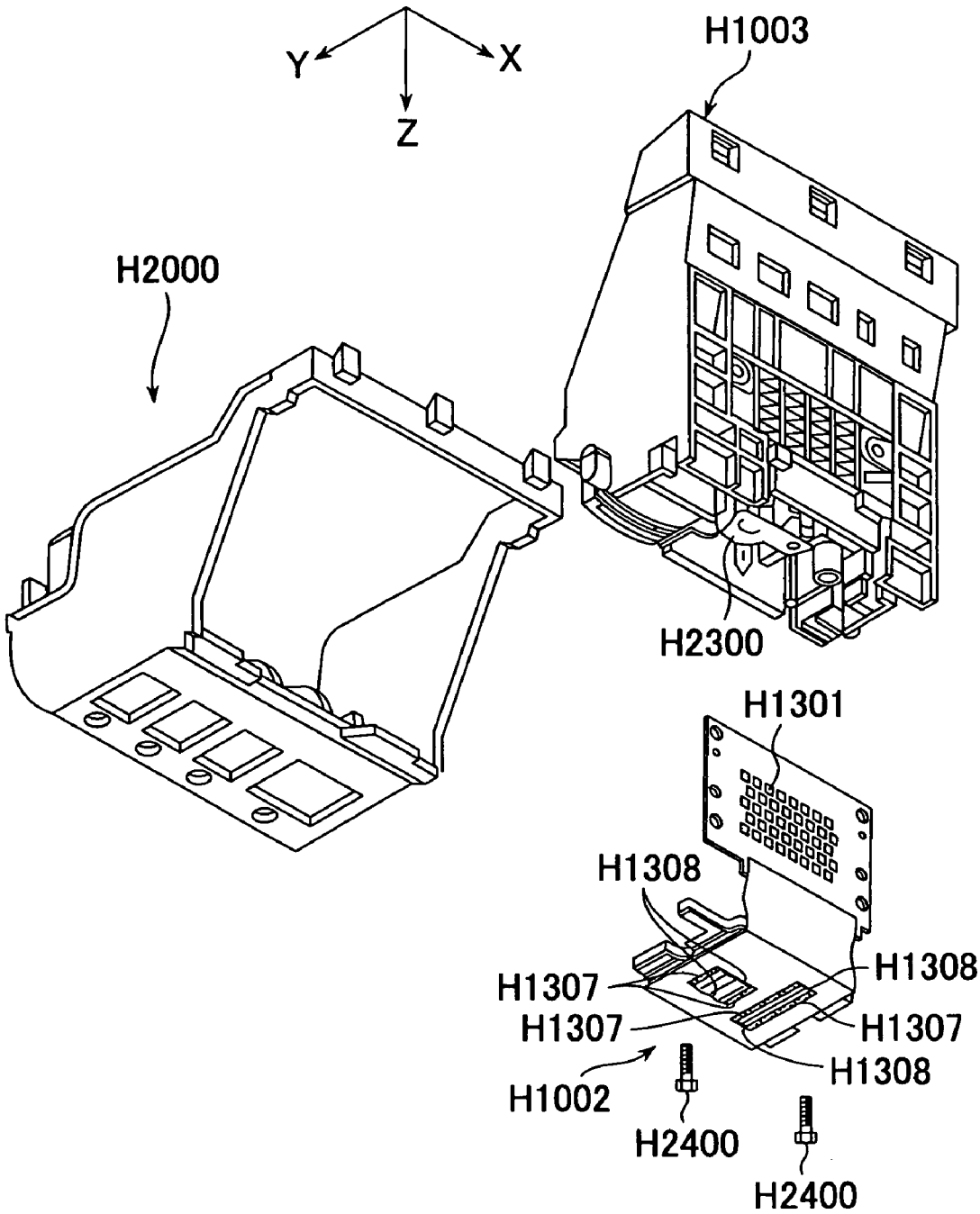
FIG. 5 is an exploded perspective view of the recording head cartridge.

As shown in FIG. 5, the recording head H1001 comprises a recording device unit H1002, an ink supply unit H1003, and a tank holder H2000.

Further, as shown in FIG. 6, the recording device unit H1002 comprises the first recording device board H1100, the second recording device board H1101, the first plate H1200, the flexible film wiring board H1300, the electrical contact board H2200, and the second plate H1400. The ink supply unit H1003 comprises the ink supply member H1500, a flow passage forming member H1600, a joint rubber H2300, filters H1700, and sealing rubbers H1800.

(1-1) Recording Device Unit

Figure 7:
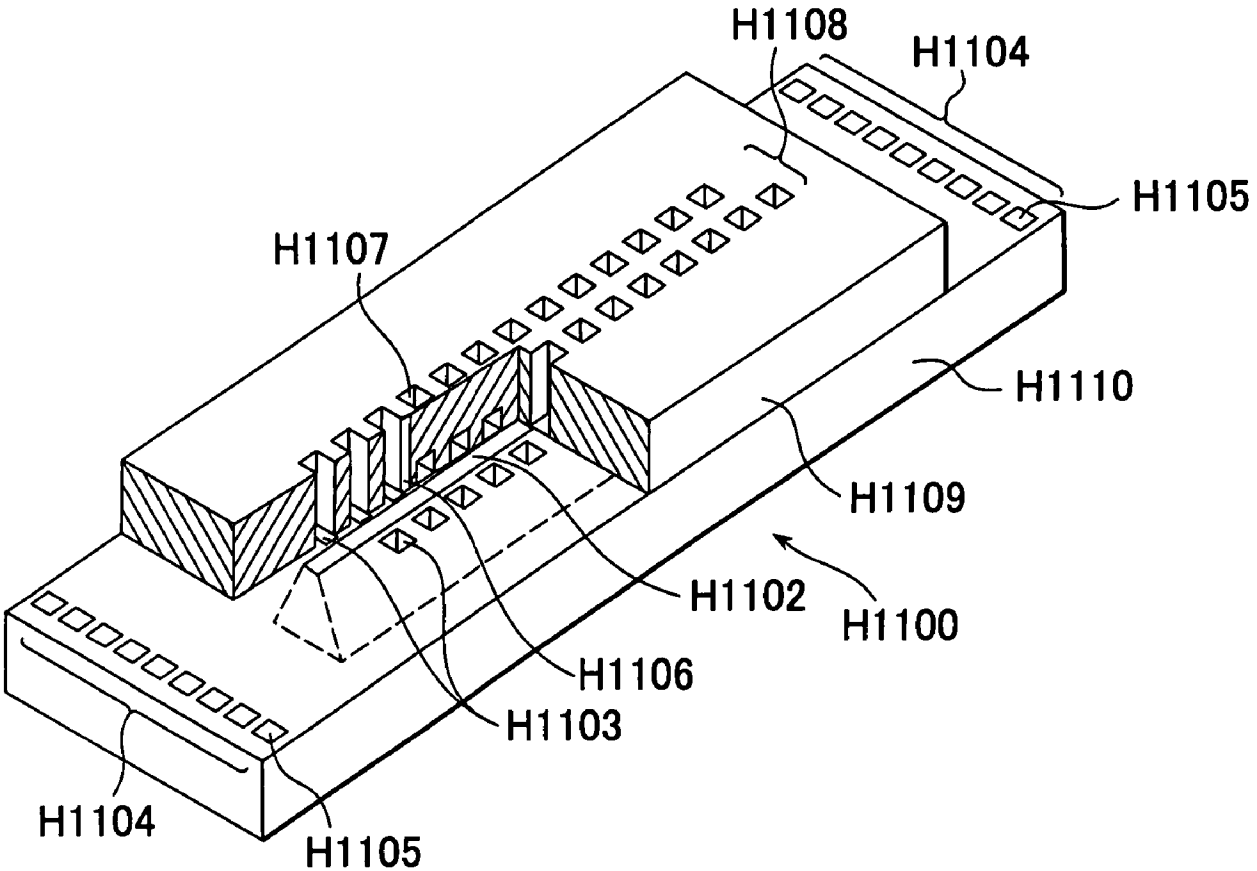
FIG. 7 is an exploded perspective view, partly broken away, of a first recording device board.

FIG. 7 is a perspective view, partly broken away, for explaining the structure of the first recording device board H1100. Note that, although the first sealing resin material reservoir H1014 and the communication grooves H1015, H1016 and H1017 are not shown in FIGS. 7 and 8, they are formed in the ejection substrate H1109 of each of the first and second recording device boards H1100, H1101.

The first recording device board H1100 is a recording device board for ejecting black ink and is constituted, for example, by a Si substrate H1110 having a thickness of about 0.5 mm to 1 mm, in which an ink supply port H1102 is formed as an ink flow passage in the shape of long groove-like through hole by anisotropic etching or sand blasting, for example, utilizing the Si crystal orientation.

In the first recording device board H1100, the electro-thermal transducers H1103 are arranged on both sides of the ink supply port H1102 in the form of a zigzag row for each side. The electro-thermal transducers H1103 and electrical wires made of, e.g., Al for supplying power to the electro-thermal transducers H1103 are formed by the film forming technique.

Further, in the recording device board H1100, the electrode pads H1104 for supplying power to the electrical wires are arranged along both ends of the first recording device board H1100, which are located perpendicularly to the direction of array of the ejection orifices H1107. The stud bumps H1105 made of, e.g., Au, are formed respectively on the electrode pads H1104. On the Si substrate H1110, the ejection substrate H1109 is disposed in which ink flow passage walls H1106 and the ejection orifices H1107 are formed by photolithography using a resin material to form ink flow passages corresponding to the electro-thermal transducers H1103, thereby forming ejection orifice rows H1108. Thus, since the ejection orifices H1107 are disposed opposite to the electro-thermal transducers H1103, ink supplied through the ink supply port H1102 is ejected upon bubbles being generated by the electro-thermal transducers H1103.

Figure 8:
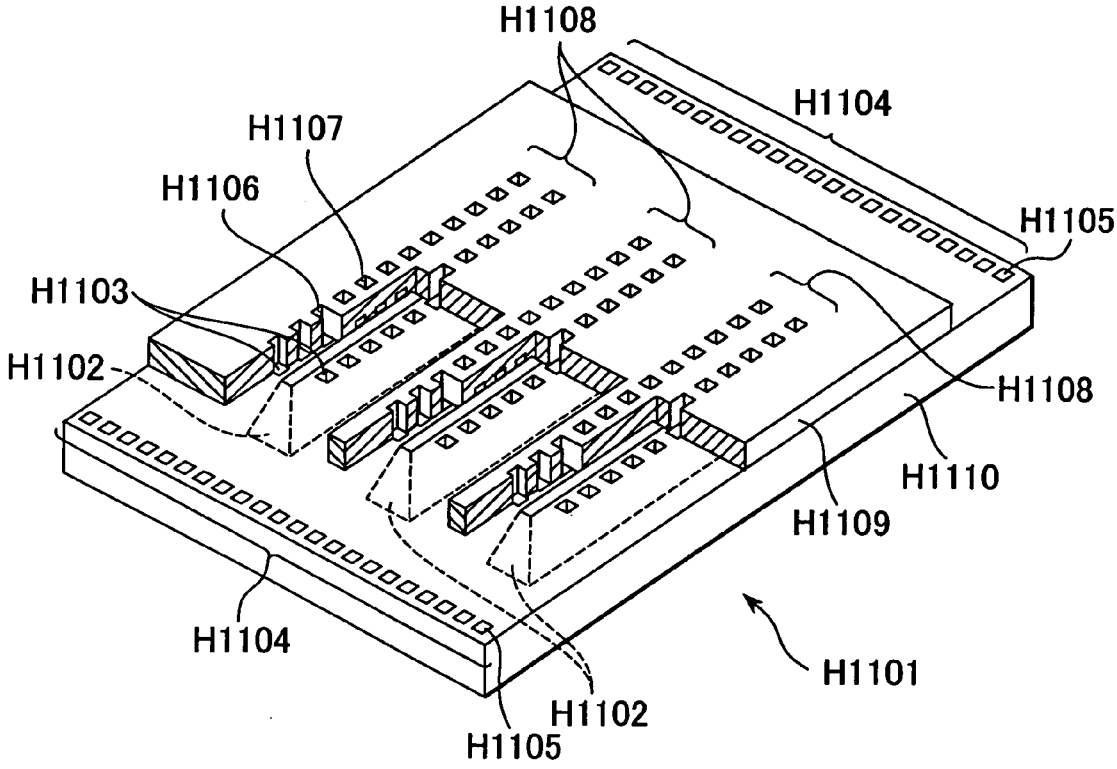
FIG. 8 is an exploded perspective view, partly broken away, of a second recording device board.

FIG. 8 is a perspective view, partly broken away, for explaining the structure of the second recording device board H1101. The second recording device board H1101 is a recording device board for ejecting inks of three colors, and includes three ink supply ports H1102 arranged in parallel. The electro-thermal transducers H1103 and the ejection orifices H1007 are disposed on both sides of each ink supply port H1102. As in the first recording device board H1100, the ink supply ports H1102, the electro-thermal transducers H1103, the electrical wires, the electrode pads H1104, etc., are formed in and on the Si substrate H1110. Also, on the Si substrate H1110, the ejection substrate H1109 is disposed in which the ink flow passages and the ejection orifices H1107 are formed by photolithography, using a resin material.

Further, as in the first recording device board H1100, the stud bumps H1105 made of, e.g., Au, are formed on the electrode pads H1104 for supplying power to the electrical wires.

The first plate H1200 is made of, for example, an alumina ($Al_2O_3$) material having a thickness of about 0.5 mm to 10 mm. Materials of the first plate H1200 are not limited to alumina, but may be one having a coefficient of linear expansion comparable to, and a coefficient of thermal conductivity comparable to or higher than, that of the material of the first recording device board H1100. More specifically, the first plate H1200 may be made of any material selected from among, e.g., silicon (Si), aluminum nitride (AlN), zirconia, silicon nitride ($Si_3N_4$), silicon carbide (SiC), molybdenum (Mo), and tungsten (W).

In the first plate H1200, there are formed one ink supply port H1201*a* for supplying black ink to the first recording device board H1100 and other three ink supply ports H1201*b* for supplying cyan, magenta and yellow inks to the second recording device board H1101. The ink supply ports H1102 of the first and second recording device boards H1100, H1101 correspond respectively to the ink supply ports H1201*a*, H1201*b* of the first plate H1200. The first recording device board H1100 and the second recording device board H1101 are fixedly bonded to the first plate H1200 while they are properly positioned with high accuracy.

A first adhesive (not shown) used for bonding the first and second recording device boards to the first plate is preferably one having a low viscosity and a relatively low hardening temperature, being able to harden in a short time, having a relatively high hardness after being hardened, and having resistance against the inks. A preferable example of the first adhesive is a thermosetting adhesive containing an epoxy resin as a main ingredient, and a thickness of an adhesive layer is preferably not more than 50 μm.

The flexible film wiring board H1300 serves to apply electrical signals for ejection of the inks to the first recording device board H1100 and the second recording device board H1101. The flexible film wiring board H1300 has a plurality of openings H1301*a*, H1301*b* in which the first and second recording device boards H1100, H1101 are assembled, respectively. Along edges of the openings H1301*a*, H1301*b*, electrode leads H1013 corresponding respectively to the electrode pads H1104 of the first and second recording device boards H1100, H1101 are provided on the flexible film wiring board H1300. Further, an electrode terminal portion H1303 is provided at one end of the flexible film wiring board H1300 for electrical connection to the electrical contact board H2200 having external signal input terminals H2201 to receive electrical signals from a control unit (not shown) incorporated in the recording apparatus. In the flexible film wiring board H1300, the electrode leads H1013 and the electrode terminal portion H1303 are connected to each other by continuous wiring patterns formed of copper foils.

The flexible film wiring board H1300 is electrically connected to the first recording device board H1100 and the second recording device board H1101. The electrical connection between those components is performed, for example, by joining the electrode pads H1104 on each recording device board H1100, H1101 to the electrode leads H1013 of the flexible film wiring board H1300 by ultrasonic thermal pressing for electrical conduction between them.

The second plate H1400 is formed of, for example, one piece of plate-like member having a thickness of about 0.5 mm to 1 mm, and is made of, for example, any of ceramics such as alumina and any of metallic materials such as Al and stainless steel (SUS). The second plate H1400 has openings H1401*a*, H1401*b* greater than the outer dimensions of the first recording device board H1100 and the second recording device board H1101 that are fixedly bonded to the first plate H1200.

In order that the first recording device board H1100 and the second recording device board H1101 can be electrically connected to the flexible film wiring board H1300 in a planar relation, the second plate H1400 is bonded to the first plate H1200 by a second adhesive (not shown), and a rear surface of the flexible film wiring board H1300 is fixedly bonded to the second plate H1400 by a third adhesive (not shown).

The electrically connected portions between the first and second recording device boards H1100, H1101 and the flexible film wiring board H1300 are sealed by the first sealing resin material H1307 and the second sealing resin material H1308, whereby the electrically connected portions are protected against corrosion caused by the inks and externally applied impacts. As shown in FIG. 3, the first sealing resin material H1307 primarily seals not only the rear side of the electrically connected portions between the electrode leads H1013 of the flexible film wiring board H1300 and the electrode pads H1104 of each recording device board H1100, H1101, but also outer peripheral portions of each recording device board H1100, H1101. The second sealing resin material H1308 seals the front side of those electrically connected portions.

To the end of the flexible film wiring board H1300, the electrical contact board H2200 having the external signal input terminals H2201 to receive electrical signals from the control unit incorporated in the recording apparatus body is electrically connected by thermal pressing using, e.g., an anisotropic conductive film.

Additionally, the flexible film wiring board H1300 is bent along one side surface of the first plate H1200 and is bonded to the side surface of the first plate H1200 by the third adhesive. The third adhesive is, e.g., a thermosetting adhesive containing an epoxy resin as a main ingredient, which is applied in thickness of about 10 μm to 100 μm.

(1-2) Ink Supply Unit

The ink supply member H1500 is formed, for example, by resin molding. A resin material for the ink supply member H1500 is preferably mixed with about 5% to 40% of glass fillers for improving rigidity in shape.

Figure 9:
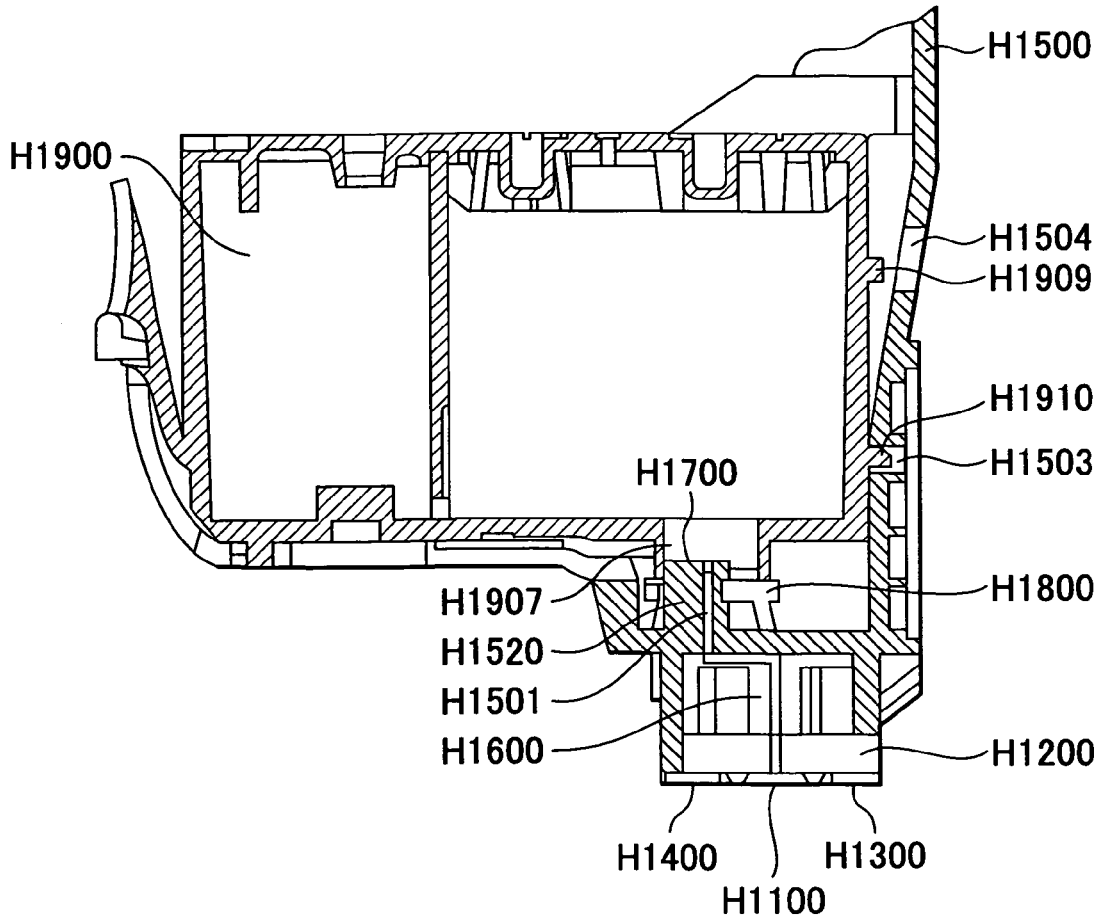
FIG. 9 is a sectional view of the recording head cartridge with the ink tank mounted in it.

As shown in FIGS. 6 and 9, the ink supply member H1500 is one component of the ink supply unit H1003 for introducing the inks from the ink tanks H1900 to the recording device unit H1002. An ink flow passage H1501 is formed by fixing the flow passage forming member H1600 to the ink supply member H1500 by ultrasonic fusing. Also, filters H1700 for preventing intrusion of foreign matters, such as dust, from the outside are joined by fusing to respective joint portions H1520 with which the ink tanks H1900 are engaged. Further, the sealing rubbers H1800 are fitted to the joint portions H1520 to prevent the inks from evaporating through the joint portions H1520.

The ink supply member H1500 has first and second engagement holes H1503, H1504 in which second and first pawls H1910, H1909 provided on the ink tank H1900 are engaged, respectively, so that the ink tank H1900 is detachably attached in place.

Moreover, the ink supply member H1500 includes a mount guide H1601 for guiding the recording head cartridge H1000 to a predetermined mount position within the carriage of the recording apparatus, and an engagement portion H1508 used for fixedly mounting the recording head cartridge H1000 to the carriage by a head setting lever.

The ink supply member H1500 further includes an X-abutment portion H1509 for positioning the recording head cartridge H1000 in the predetermined mount position within the carriage in the X-direction (scan direction of the carriage), a Y-abutment portion H1510 for positioning thereof in the Y-direction (feed direction of a recording medium), and a Z-abutment portion H1511 for positioning thereof in the Z-direction (direction of ink droplet ejection).

In addition, the ink supply member H1500 includes a terminal fixing portion H1512 for fixing the electrical contact board H2200 of the recording device unit H1002 while positioning it in place. A plurality of ribs are provided on the terminal fixing portion H1512 and its surroundings to increase rigidity of a surface in which the terminal fixing portion H1512 is provided.

(1-3) Joining between Recording Head Unit and Ink Supply Unit

The recording head H1001 is completed, as shown in FIG. 5, by joining the recording device unit H1002 to the ink supply unit H1003, and then joining a resulting assembly to the tank holder H2000. This joining step is performed as follows.

The recording element unit H1002 and the ink supply unit H1003 are fixed together by screws H2400 in a pressure contact state with the joint rubber H2300 situated therebetween such that the ink supply port of the recording device unit H1002 (i.e., the ink supply port H1201 of the first plate H1200) and the ink supply port of the ink supply unit H1003 (i.e., an ink supply port H1602 of the flow passage forming member H1600) are communicated with each other without causing a leak of the inks. At the same time, the recording device unit H1002 is fixed after being precisely positioned with respect to the reference points on the ink supply unit H1003 in the X-, Y- and Z-directions.

Figure 10:
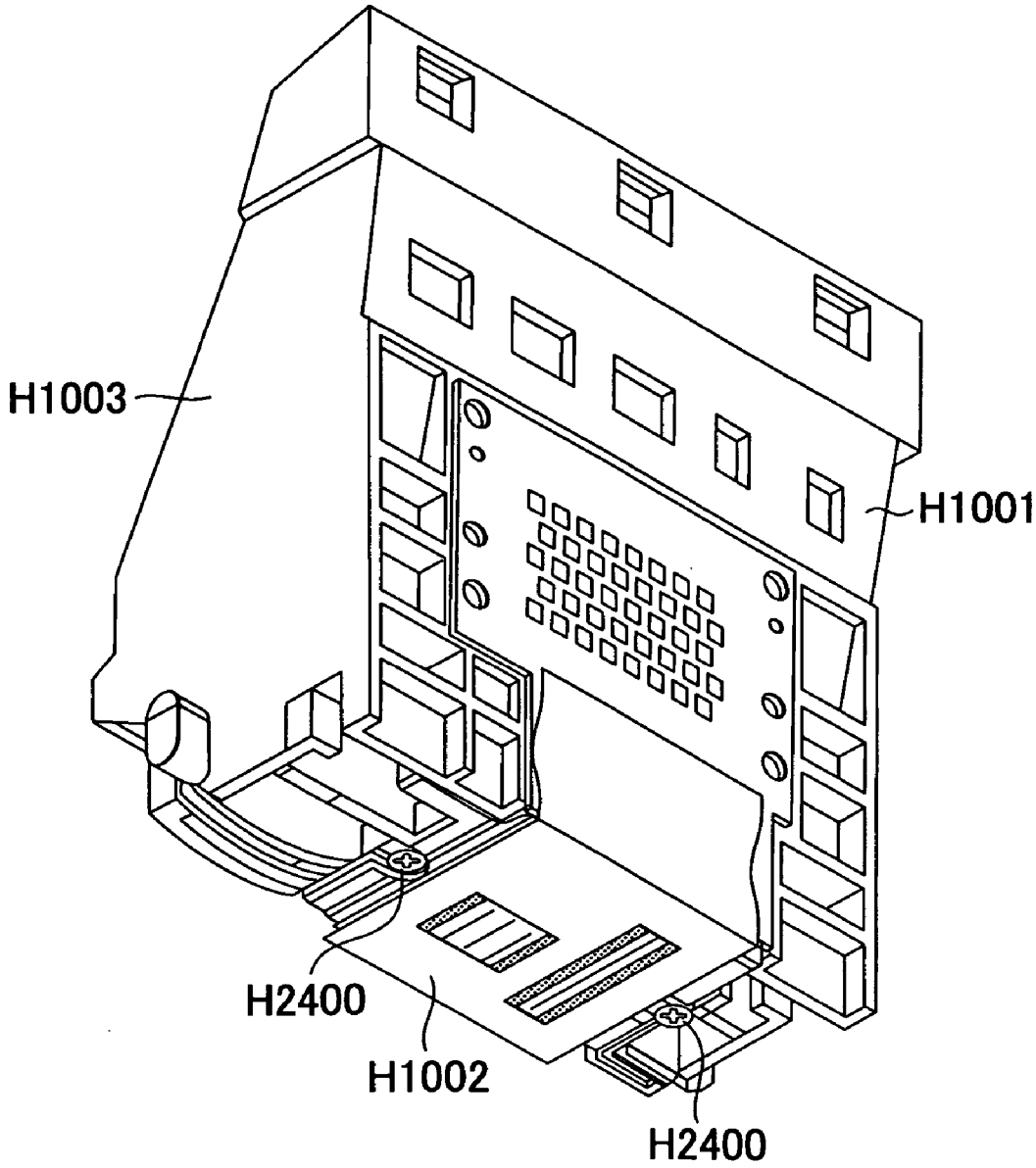
FIG. 10 is a perspective view showing an ink supply unit mounted to the recording head cartridge.
Figure 11:
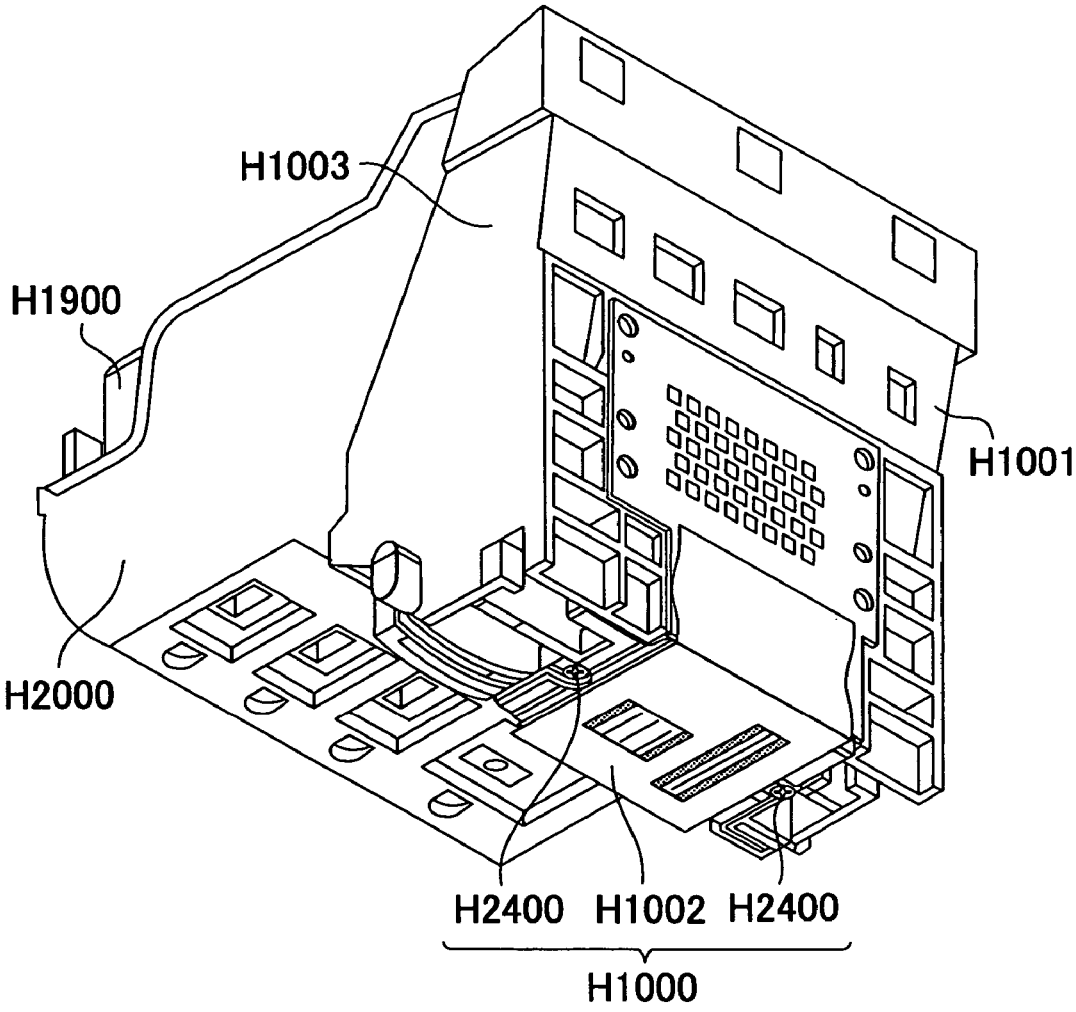
FIG. 11 is a perspective view of the recording head cartridge.

Then, the electrical contact board H2200 of the recording device unit H1002 is fixed to one side surface of the ink supply member H1500, while it is precisely positioned in place, by engaging terminal positioning pins H1515 (two locations) in terminal positioning holes H1309 (two locations). This fixing is performed, for example, by caulking terminal coupling pins H1516 provided on the ink supply member H1500, but may be performed using any other suitable fixing means. A thus-completed assembly of the recording device unit H1002 and the ink supply unit H1003 is shown in FIG. 10.

Further, the recording head H1001 is completed by fitting and joining the tank holder H2000 to the ink supply member H1500 through joint holes and projections provided on the ink supply member H1500 for joining to the tank holder H2000. The recording head H1001 thus completed is shown in FIG. 10.

(2) Recording Head Cartridge

FIG. 4 is a perspective view showing a state in which the ink tanks H1901, H1902, H1903 and H1904 are mounted to the recording head H1001 as one component of the recording head cartridge H1000.

The ink tanks H1901, H1902, H1903 and H1904 contain the inks of the corresponding colors. Also, as shown in FIG. 9, each ink tank is formed with an ink supply port H1907 for supplying the ink in each ink tank to the recording head H1001. For example, when the ink tank H1901 is mounted to the recording head H1001, the ink supply port H1907 of the ink tank H1901 is brought into pressure contact with the filter H1700 provided in the joint portion H1520 of the recording head H1001, and the black ink in the ink tank H1901 is supplied to the first recording device board H1100 from the ink supply port H1907 through the ink flow passage H1501 of the recording head H1001 and then through the first plate H1200.

Subsequently, the ink is supplied to a bubbling chamber provided with the electro-thermal transducers H1103 and the ejection orifices H1107. The ink is then ejected toward a recording medium, e.g., a sheet of recording paper, with thermal energy applied from the electro-thermal transducers H1103.

According to the recording head H1001 of the embodiment, as described above, the first sealing resin material H1307 having elasticity even after hardening is applied in the recesses defined by the openings H1301*a*, H1301*b* of the flexible film wiring board H1300, the openings H1401*a*, H1401*b* of the second plate H1400 and the outer peripheries of the recording device boards H1100, H1101, around the recording device boards H1100, H1101, and over the electrically connected portions between the electrode pads H1104 and the stud bumps H1105 both provided on each of the recording device boards H1100, H1101. Therefore, the recording device boards H1100, H1101 and the electrically connected portions between the electrode pads H1104 and the stud bumps H1105 are protected against failures that may otherwise occur due to deformations caused, for example, upon thermal expansion and shrinkage of the electrode leads H1013 of the flexible film wiring board H1300. Further, the recording head H1001 is able to ensure reliability in the operation and to improve productivity.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid ejection head for ejecting a liquid through an ejection orifice comprising:

a recording device board including an energy generating device disposed thereon to generate energy for ejecting the liquid through the ejection orifice;

an electrode pad disposed in a recess formed in the recording device board, the electrode pad being electrically communicated with the energy generating device;

an electrode lead for supplying power to the electrode pad externally of the recording device board;

a plurality of bumps on the recording device board for connecting the electrode pad and the electrode lead to establish electrical communication therebetween, wherein two adjacent bumps are communicated with each other through a communication groove and wherein at least one of the bumps is communicated with an outer peripheral edge of the recording device board; and a first sealing resin material filled in the recess to surround an electrically connected portion between the electrode pad and the bump without covering the bump.

2. The liquid ejection head according to claim 1, wherein the first sealing resin material is a thermosetting resin material having elasticity even after hardening, and second sealing resin material, which is another kind of thermosetting resin material having rigidity after hardening, is applied on the first sealing resin material to cover the plurality of bumps and the electrode lead.

3. The liquid ejection head according to claim 2, wherein the first sealing resin material is a thermosetting silicone-denatured epoxy resin.

4. The liquid ejection head according to claim 2, wherein the second sealing resin material is a thermosetting epoxy resin.

5. The liquid ejection head according to claim 1, wherein a portion of a bump electrically connected to the electrode lead is projected from the recess.

6. The liquid ejection head according to claim 1, wherein each bump has an affinitive area having affinity with the sealing resin material and formed nearer to a connection surface thereof to the electrode pad and a repellent area having a lower affinity with the sealing resin material and formed nearer to a connection surface thereof to the electrode lead.

7. The liquid ejection head according to claim 1, wherein each bump is formed such that a cross-sectional area of the bump parallel to a principal face of the electrode pad is larger in a portion of the bump nearer to a connection surface thereof to the electrode lead than in a portion of the bump nearer to a connection surface thereof to the electrode pad.

8. A recording device board used in a liquid ejection head for ejecting a liquid through an ejection orifice and including an energy generating device disposed thereon to generate energy for ejecting the liquid through the ejection orifice with electric power supplied from an electrode lead, the recording device board comprising:

an electrode pad disposed in a recess formed in the recording device board, the electrode pad being electrically communicated with the energy generating device; and a plurality of bumps on the recording device board for receiving the electrical power supplied to the electrode pad through the electrode lead externally of the recording device board, wherein two adjacent bumps are communicated with each other through a communication groove, wherein at least one of the bumps is communicated with an outer peripheral edge of the recording device board, and wherein each bump has an affinitive area having affinity with a sealing resin material and formed nearer to a connection surface thereof to the electrode pad and a repellent area having a lower affinity with the sealing resin material and formed nearer to a connection surface thereof to the electrode lead.

9. The recording device board according to claim 8, wherein each bump is formed such that a cross-sectional area of the bump parallel to a principal face of the electrode pad is larger in a portion of the bump nearer to a connection surface thereof to the electrode lead than in a portion of the bump nearer to a connection surface thereof to the electrode pad.

10. A recording device board used in a liquid ejection head for ejecting a liquid through an ejection orifice and including an energy generating device disposed thereon to generate energy for ejecting the liquid through the ejection orifice with electric power supplied from an electrode lead, the recording device board comprising:

an electrode pad disposed in a recess formed in the recording device board, the electrode pad being electrically communicated with the energy generating device; and a plurality of bumps on the recording device board for receiving power supplied to the electrode pad through the electrode lead externally of the recording device board, wherein two adjacent bumps are communicated with each other through a communication groove, wherein at least one of the bumps is communicated with an outer peripheral edge of the recording device board, and wherein each bump is formed such that a cross-sectional area of the bump parallel to a principal face of the electrode pad is larger in a portion of the bump nearer to a connection surface thereof to the electrode lead than in a portion of the bump nearer to a connection surface thereof to the electrode pad.

11. A method of manufacturing a liquid ejection head comprising:

a recording device board including a nozzle member in which an ejection orifice for ejecting a liquid and a flow passage for introducing the liquid to the ejection orifice are formed, and a supply port supplied with the liquid to be ejected through the ejection orifice;

a flexible film wiring board including an opening in which the recording device board is assembled, and an electrode lead provided near the opening for electrical connection to the recording device board, the flexible film wiring board applying an electrical pulse for ejecting the liquid to the recording device board;

a support member for supporting the recording device board;

a support plate having an opening through which the recording device board and the support member are abutted with each other, the support plate being interposed between the flexible film wiring board and the support member to support the flexible film wiring board; and first and second sealing resin materials filled in recesses defined by the opening of the flexible film wiring board, the opening of the support plate, and an outer periphery of the recording device board, the method comprising the steps of:

fixedly bonding the recording device board to the support member and fixedly bonding the flexible film wiring board to the support plate;

filling a first sealing resin material, which is a thermosetting resin material having elasticity after hardening, in the recesses, and of filling and hardening the first sealing resin material in a first sealing resin material reservoir formed to surround an electrically connected portion between each of a plurality of bumps on the recording device board and an electrode pad provided on the recording device board, wherein two adjacent bumps are communicated with each other through a communication groove and wherein at least one of the bumps is communicated with an outer peripheral edge of the recording device board;

electrically connecting the electrode pad on the recording device board to the electrode lead of the flexible film wiring board through the plurality of bumps; and covering an electrically connected portion between the recording device board and the flexible film wiring board with a second sealing resin material which is a thermosetting resin material having rigidity after hardening.

12. The method of manufacturing a liquid ejection head according to claim 11, wherein connection points between the recording device board and the flexible film wiring board are all electrically connected at a time.

13. The method of manufacturing a liquid ejection head according to claim 11, wherein connection points between the recording device board and the flexible film wiring board are electrically connected one by one.

* * * * *